US010414546B2

(12) United States Patent
Hernandez et al.

(10) Patent No.: US 10,414,546 B2
(45) Date of Patent: Sep. 17, 2019

(54) STACKABLE CONTAINER

(71) Applicant: HOME PRODUCTS INTERNATIONAL—NORTH AMERICA, INC., Chicago, IL (US)

(72) Inventors: Rolando Hernandez, Oak Lawn, IL (US); Gabriel Prero, Chicago, IL (US)

(73) Assignee: HOME PRODUCTS INTERNATIONAL—NORTH AMERICA, INC., Chicago, IL (US)

( * ) Notice: Subject to any disclaimer, the term of this patent is extended or adjusted under 35 U.S.C. 154(b) by 111 days.

(21) Appl. No.: 15/674,196

(22) Filed: Aug. 10, 2017

(65) Prior Publication Data

US 2019/0047748 A1 Feb. 14, 2019

(51) Int. Cl.

| | |
|---|---|
| ***B65D 21/04*** | (2006.01) |
| ***B65D 21/02*** | (2006.01) |
| ***B65D 1/38*** | (2006.01) |
| ***D06F 95/00*** | (2006.01) |
| ***B65D 25/28*** | (2006.01) |

(52) U.S. Cl.

CPC ..... *B65D 21/046* (2013.01); *B65D 1/38* (2013.01); *B65D 21/0212* (2013.01); *B65D 25/2888* (2013.01); *D06F 95/002* (2013.01)

(58) Field of Classification Search

CPC .... B65D 21/046; B65D 21/043; B65D 21/04; B65D 21/0233; B65D 21/0235; B65D 21/02; B65D 21/0212; B65D 21/0209; B65D 1/38; B65D 1/40; B65D 11/20; B65D 25/24; B65D 25/22; B65D 21/041; D06F 95/002

USPC ..... 206/507, 506, 505, 504, 518, 519, 510, 206/509; 220/676, 23.86, 23.83, 608, 220/623, 628, 756, 658, 657, 656; D32/37

See application file for complete search history.

(56) References Cited

U.S. PATENT DOCUMENTS 1,207,279 A * 12/1916 Crum ..... B65D 25/24 206/507
2,994,457 A 8/1961 Fornas
3,270,913 A 9/1966 Bridenstine et al.
(Continued)

FOREIGN PATENT DOCUMENTS

GB 1503555 A * 3/1978 ..... B65D 21/045

*Primary Examiner* — Robert J Hicks
(74) *Attorney, Agent, or Firm* — Neal, Gerber & Eisenberg LLP

(57) ABSTRACT

A container capable of being placed in a stacking configuration with an identical second container includes a bottom, a top rim defining an open top, and a sidewall contiguous with and extending between the bottom and the top rim to define an inner space. The container further includes a first curved structure forming at least part of the top rim adjacent a first sidewall side and a second curved structure forming at least part of the top rim adjacent a second sidewall side and disposed opposite the first curved structure. The container also includes first and second channels molded into the bottom and at least partially protruding into the inner space, the channels being substantially parallel to each other and to first and second sidewall ends, wherein a distance between the first and second channels is substantially equal to a first distance between the first and second curved structures.

20 Claims, 9 Drawing Sheets

(56) References Cited

U.S. PATENT DOCUMENTS

| | | | | |
|---|---|---|---|---|
| 3,326,410 | A * | 6/1967 | Asenbauer | B65D 21/045 206/504 |
| 3,379,339 | A * | 4/1968 | Asenbauer | B65D 21/046 206/506 |
| D264,040 | S * | 4/1982 | Kunze | D32/37 |
| 5,071,008 | A | 12/1991 | Hradisky | |
| D372,568 | S * | 8/1996 | Lippisch | D32/37 |
| 6,874,650 | B2 * | 4/2005 | Welsh | B65D 21/0222 220/508 |
| 7,207,460 | B2 | 4/2007 | Sander et al. | |
| 7,677,408 | B2 | 3/2010 | Loucks et al. | |
| 9,174,769 | B1 | 11/2015 | Zephir et al. | |
| 2005/0189360 | A1 * | 9/2005 | Loucks | D06F 95/002 220/676 |
| 2006/0180491 | A1 * | 8/2006 | Zephir | B65D 21/046 206/507 |
| 2006/0208439 | A1 | 9/2006 | Depasquale et al. | |
| 2010/0294694 | A1 * | 11/2010 | Palmer | B65D 21/045 206/519 |
| 2013/0105489 | A1 * | 5/2013 | Burgess | D06F 95/002 220/533 |
| 2016/0113372 | A1 * | 4/2016 | Perlik | A45C 5/00 220/676 |

* cited by examiner

STACKABLE CONTAINER

TECHNICAL FIELD

The present disclosure relates to containers, such as, for example, laundry baskets, and more particularly, to containers that can be stacked on top of one another.

BACKGROUND

Some laundry baskets are open-top, nestable containers. The nestable feature can be a useful space saver when storing multiple laundry baskets. During use, the open-top design allows easy access to an interior space defined by the laundry basket. In some cases, a user may want to use multiple laundry baskets at a time, for example, in order to sort laundry into different piles. In such cases, existing laundry baskets must be placed side by side in order to allow access to all of the baskets at once. Depending on the number of baskets, this configuration can require a large amount of floor or table space, which may not be available in many laundry rooms or laundry mat locations. Accordingly, there is still a need in the art for a set of containers that can provide both efficient and space-saving utility.

SUMMARY

The invention is intended to solve the above-noted and other problems by providing a stackable and nestable container that is designed to enable access to the interior space of the container even while in a stacked position.

For example, one embodiment includes a container capable of being placed in a stacking configuration with an identical second container. The container includes a bottom, a top rim defining an open top, and a sidewall contiguous with and extending between the bottom and the top rim to define an inner space. The sidewall includes a first side, a second side opposite and generally parallel to the first side, a first end, and a second end opposite and generally parallel to the first end, wherein the first and second ends are generally perpendicular to the first and second sides. The container also includes a first curved structure forming at least part of the top rim adjacent the first side and a second curved structure forming at least part of the top rim adjacent the second side, the second curved structure being disposed opposite the first curved structure, wherein the first curved structure is spaced apart from the second curved structure by a first distance. The container also includes first and second channels molded into the bottom and at least partially protruding into the inner space, the channels being substantially parallel to each other and to the first and second ends, wherein a distance between the first and second channels is substantially equal to the first distance between the first and second curved structures.

Example embodiments also include first and second stackable containers, each container comprising a bottom, a top rim defining an open top, and a sidewall contiguous with and extending between the bottom and the top rim to define an inner space. The sidewall of each container includes a first side, a second side opposite and generally parallel to the first side, a first end, and a second end opposite and generally parallel to the first end, wherein the first and second ends are generally perpendicular to the first and second sides. Each container also includes a first curved structure forming at least part of the top rim adjacent the first side and a second curved structure forming at least part of the top rim adjacent the second side, the second curved structure being disposed opposite the first curved structure, wherein the first curved structure is spaced apart from the second curved structure by a first distance. Each container further includes first and second channels molded into the bottom and at least partially protruding into the inner space, the channels being substantially parallel to each other and to the first and second ends, wherein a distance between the first and second channels is equal to the first distance between the first and second curved structures.

As will be appreciated, this disclosure is defined by the appended claims. The description summarizes aspects of the embodiments and should not be used to limit the claims. Other implementations are contemplated in accordance with the techniques described herein, as will be apparent to one having ordinary skill in the art upon examination of the following drawings and detail description, and such implementations are intended to within the scope of this application.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION

Figure 1:
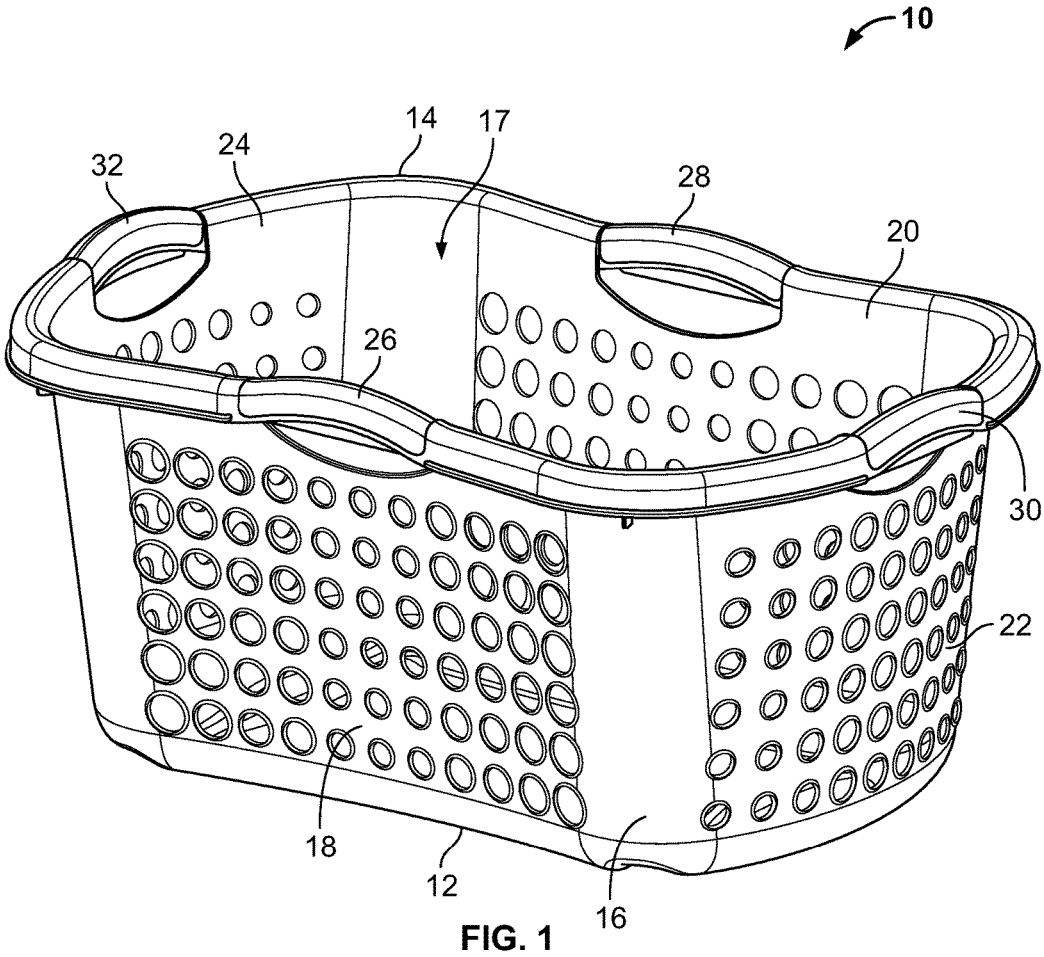
FIG. 1 is a front perspective view of a stackable laundry basket, in accordance with various embodiments.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Stackable and nestable containers typically comprise an open top, generally rectangular body that is constructed so that in a first position, the upper container will nest within the bottom container, and in a second position, the upper container will stack vertically on top of the bottom container. When in the first/nesting position, all sides of the upper container are typically aligned exactly on top of corresponding sides of the bottom container. In most cases, the second/stacking position is achieved by rotating the upper container relative to the bottom container, for example, by 180 degrees, so that the upper container engages structures included on the bottom container for enabling stacking. The same structures may be avoided or engaged differently when the upper container is rotated another 180 degrees into the first position, thus enable nesting. Some containers include a secondary part that must be manually installed or attached to the container in order to enable stacking, and manually removed from the container before nesting.

Most existing nestable, stackable containers do not allow access to an interior space of the container while in the stacked position, at least because the sidewalls of the containers must be lined up exactly in order to engage the stacking structures, thus walling off the interior spaces of the containers. Some existing stackable containers have at least one downward sloping sidewall, so that at least one side of the container remains open or accessible when multiple containers are stacked together. However, due to the open sidewall, the container is not useful for carrying or transporting loose items, such as clothing or other laundry.

FIGS. 1 through 7 illustrate an example stackable and nestable container 10, in accordance with embodiments. As shown, the container 10 includes a bottom 12, a top rim 14 defining an open top, and a sidewall 16 contiguous with and extending between the bottom 12 and the top rim 14 to define an inner space 17. While the container 10 is shown as a laundry basket with openings in the sidewall 16 to allow air circulation through the inner space 17, it will be appreciated that the stackable and nestable container 10 may be any type of bin, basket, or other container with four walls, a solid bottom, and an open top. The container 10 can be made of any suitable material, including, for example, a hard plastic or other sturdy material. In some embodiments, the container 10 can be a one-piece container molded or formed from a single sheet of material.

Figure 4:
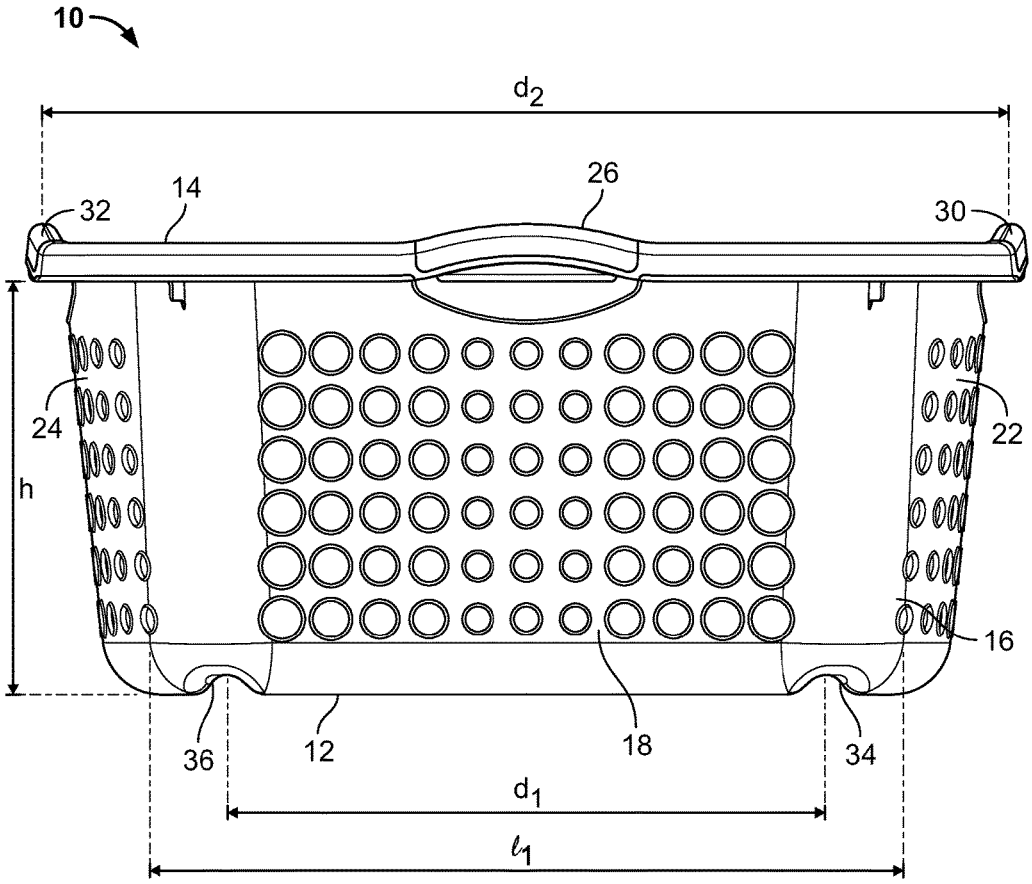
FIG. 4 is a side elevational view of the laundry basket shown in FIG. 1, in accordance with various embodiments.

The sidewall 16 includes a first side 18 and a second side 20 disposed opposite and generally parallel to the first side 18. The sidewall 16 also includes a first end 22 and a second end 24 disposed opposite and generally parallel to the first end 22. In embodiments, the container 10 can have a generally rectangular shape. For example, the first and second ends 22 and 24 can be generally perpendicular to the first and second sides 18 and 20, and a length $l_1$ of the first side 18 (or the second side 20) can be greater than a length $l_2$ of the first end 22 (or the second end 24). As shown in FIG. 4, the sidewall 16 can have a generally uniform height h, such that each of the first side 18, the second side 20, the first end 22, and the second end 24 has substantially the same height. As a result, articles of clothing or other items can be securely stored in the inner space 17 of the container 10 without risk of falling out.

The container 10 can further include a plurality of handles coupled to or forming at least part of the top rim 14. As shown in FIG. 1, the plurality of handles can include a first handle 26 disposed on, or integrated into, a portion of the top rim 14 that is adjacent to the first side 18 and a second handle 28 disposed on, or integrated into, a portion of the top rim 14 that is adjacent to the second side 20. In embodiments, the first handle 26 can be substantially centered on the first side 18, and the second handle 28 can be substantially centered on the second side 20, such that the first handle 26 is located directly opposite the second handle 28.

In some embodiments, the plurality of handles also includes a third handle 30 disposed on, or integrated into, a portion of the top rim 14 that is adjacent to the first end 22 and a fourth handle 32 disposed on, or integrated into, a portion of the top rim 14 that is adjacent to the second end 24. In such embodiments, the third handle 30 can be substantially centered on the first end 22, and the fourth handle 32 can be substantially centered on the second end 24, such that the third handle 30 is directly opposite the fourth handle 32. While the illustrated embodiment shows four handles 26, 28, 30, and 32 to provide at least two modes for carrying the container 10 (e.g., by the sides 18 and 20 or by the ends 22 and 24), it should be appreciated that other embodiments may include only the two handles 26 and 28 on the two sides 18 and 20 of the container 10.

Each of the handles 26, 28, 30, and 32 curves upwards from the two sides of the handle, so as to have a generally arched shape designed to facilitate gripping of the container 10 along the top rim 14. As shown in FIG. 4, the center of each handle extends above the remainder of the top rim 14, and a base of the handle includes an opening or space for insertion of the user's fingers during handling of the container 10. A thickness of each handle 26, 28, 30, and 32 and a size and shape of the opening at the base of each handle can be selected to facilitate optimal handling of the container 10. In some embodiments, each of the handles 26, 28, 30, and 32 can also include a soft rubber material designed to provide both a comfortable feel and a sturdy, non-slip grip for the user of the container 10.

Figure 2:
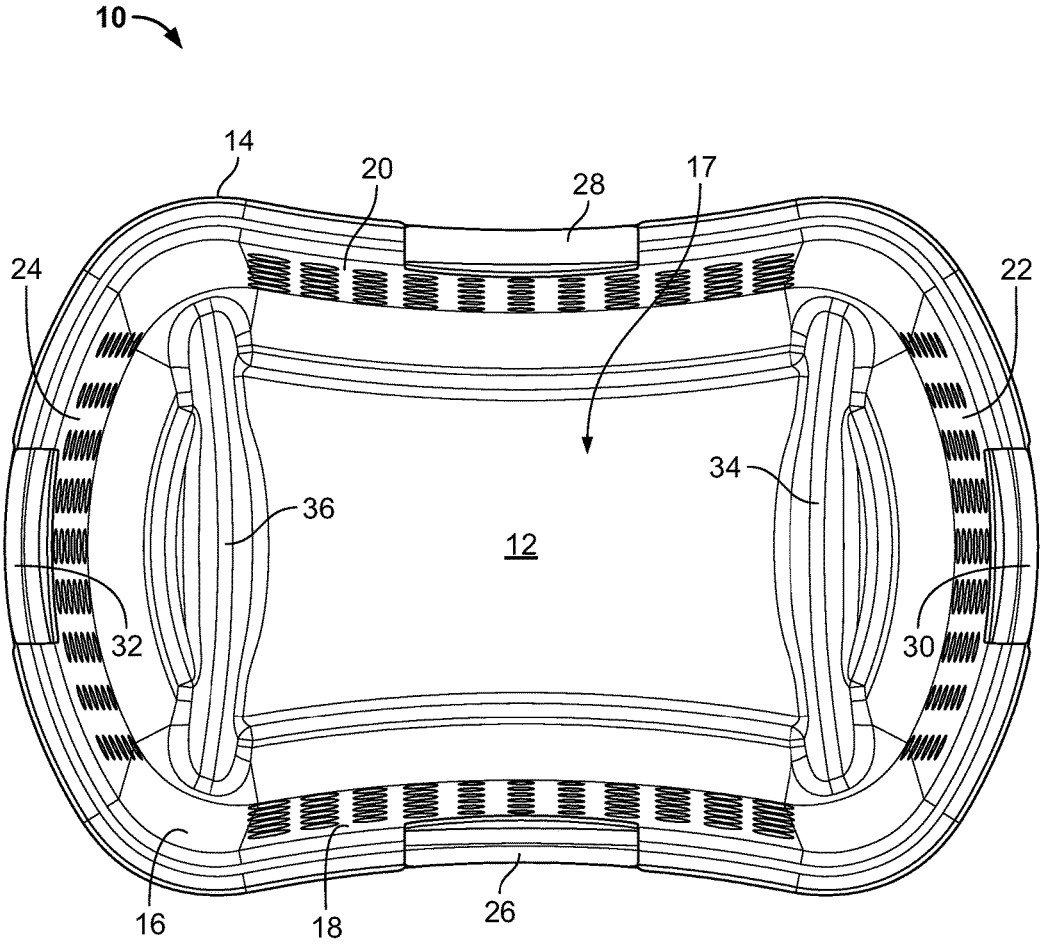
FIG. 2 is a top plan view of the laundry basket shown in FIG. 1, in accordance with various embodiments.

As shown in FIG. 2, the first handle 26 is spaced apart from the second handle 28 by a first distance $d_1$ that spans transversely across the container 10. As shown in FIG. 4, the third handle 30 is spaced apart from the fourth handle 32 by a second distance $d_2$ that spans lengthwise across the container 10. In embodiments, the first distance $d_1$ and the second distance $d_2$ can be selected at least partially based on a desired circumference for the top rim 14 and/or a desired size and shape for the container 10. In some embodiments, the first distance $d_1$ and the second distance $d_2$ is further selected to provide comfortable handling of the container 10. For example, the second distance $d_2$ may be selected based on an average wingspan of a group of potential users because the handles 30 and 32 may be used when the user is carrying the container 10 with both hands, or by placing a hand on each of the ends 22 and 24 of the container 10. Similarly, the first distance $d_1$ may be selected based on an average armlength of the group of potential users because the handles 26 and 28 may be used in the alternative, or when the user is holding one of the sides 18 or 20 with one hand and resting or pressing the other side 20 or 18 of the container 10 against the user's hip or side.

In embodiments, central portions of the first and second sides 18 and 20 can bend or curve inwards towards the inner space 17, as shown in FIG. 2, to allow for more ergonomical handling of the container 10. For example, the curved, central portions of the first and second sides 18 and 20 may be designed for a more comfortable fit when placed against a hip or other body part as the user holds or carries the container 10. In some embodiments, central portions of the first and second ends 22 and 24 can be rounded or curve outwards away from the inner space 17, as shown in FIG. 2, to increase the amount of inner space 17 within the container 10. For example, the distance $d_2$ between the third and fourth handles 30 and 32 can be greater than the length $l_1$ of the first side 18 (or the second side 20), as shown in FIG. 4.

Figure 5:
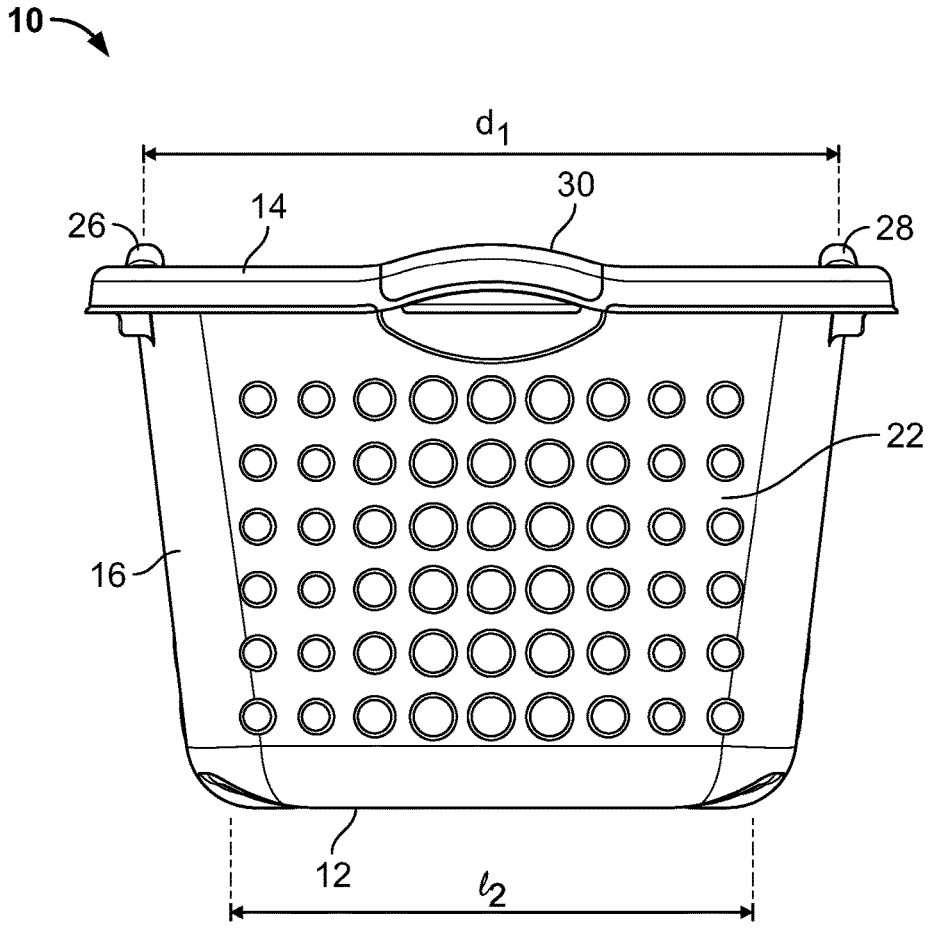
FIG. 5 is a front elevational view of the laundry basket shown in FIG. 1, in accordance with various embodiments.
Figure 6:
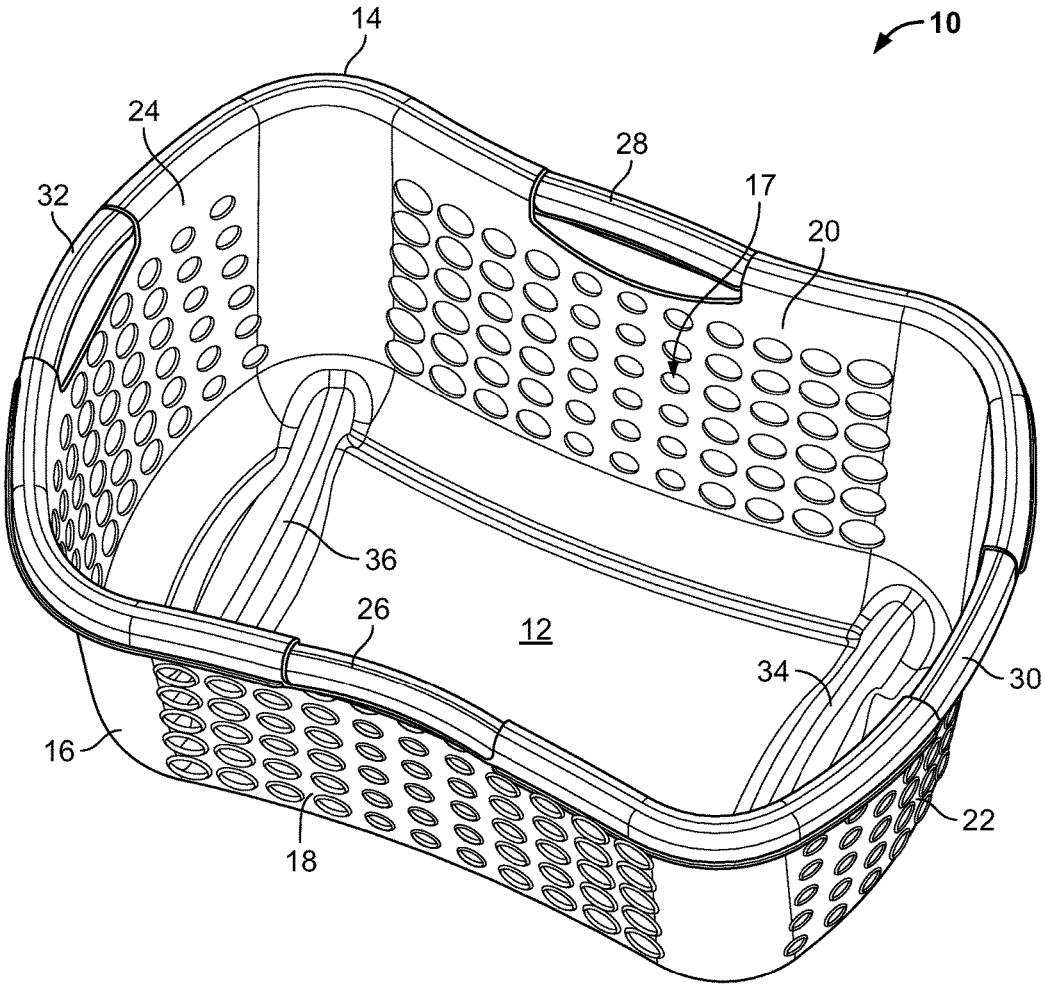
FIG. 6 is a top perspective view of the laundry basket shown in FIG. 1, in accordance with various embodiments.

In some embodiments, certain features of the container 10 can be configured to enable placement of the container 10 in a nesting configuration with another identical container. For example, portions of the sidewall 14 can slope at least slightly outwards from the bottom 12 to the top rim 14, as shown in FIG. 5, such that a circumference of the top rim 14 is greater than a circumference of the bottom 12. Also, the edges of the bottom 12 and the sidewall 14 can be rounded or curved to facilitate placement of the container 10 into the other identical container to achieve the nesting configuration.

Figure 8:
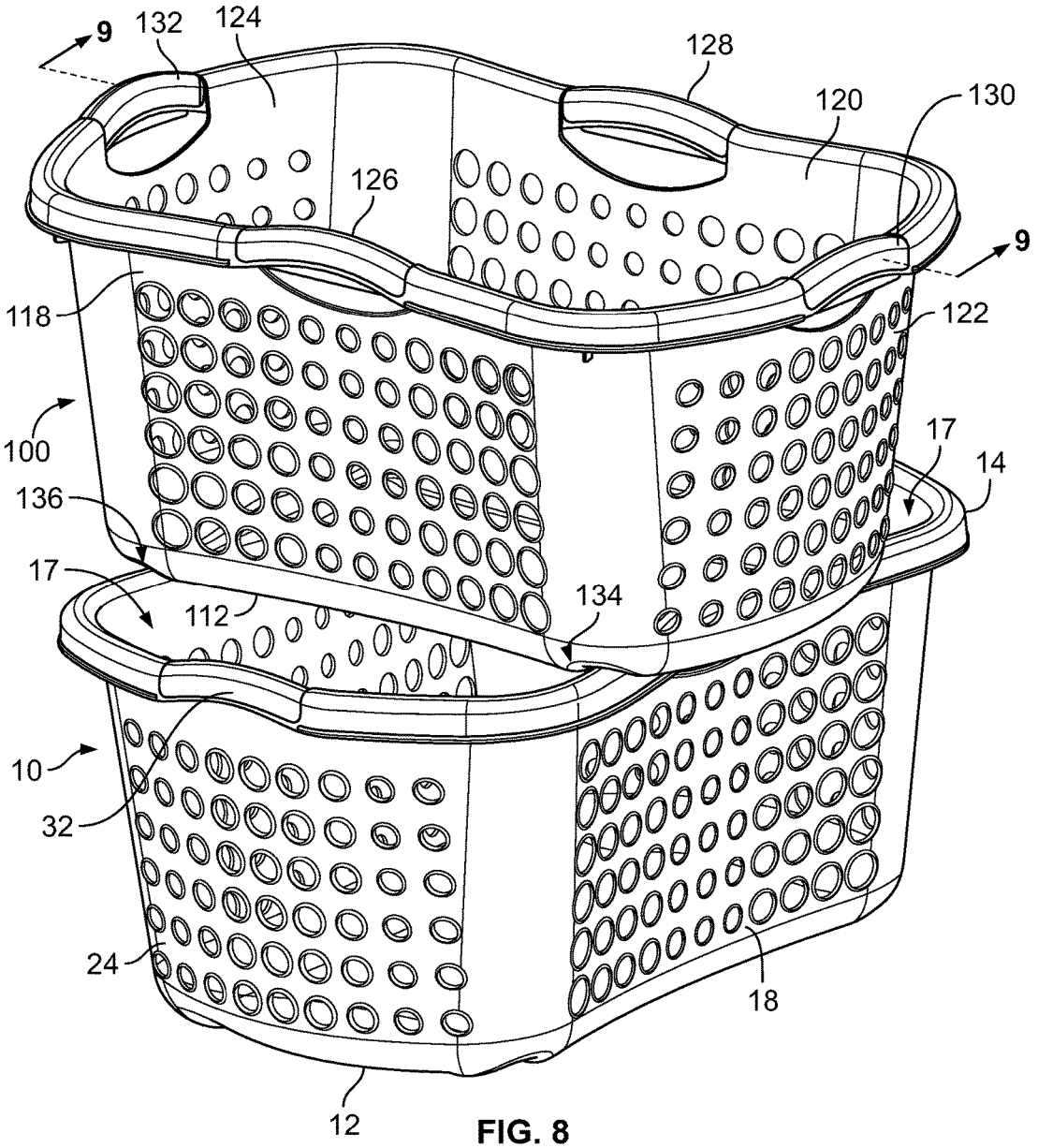
FIG. 8 illustrates the laundry basket of FIG. 1 in a stacked configuration, in accordance with various embodiments.
Figure 9:
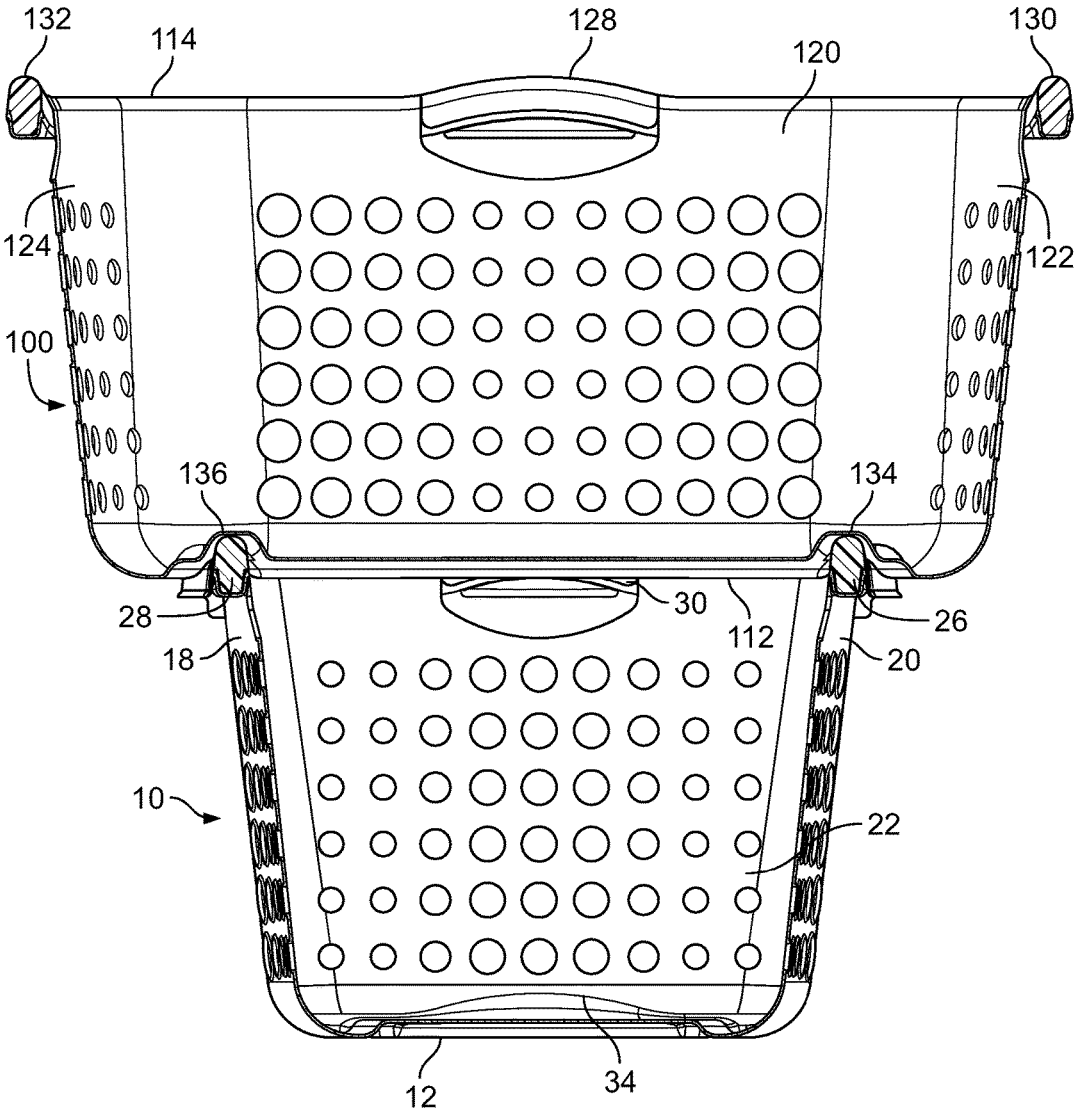
FIG. 9 is a cross-sectional view of the stacked configuration shown in FIG. 8, in accordance with various embodiments.

As shown in FIGS. 8 and 9, the container 10 is capable of being placed in a stacking configuration with a second container 100 that is substantially identical to the container 10. For example, as shown in FIG. 8, the second container 100 has a bottom 112 and a top rim 114, similar to the bottom 12 and top rim 14 of the container 10, first and second sides 118 and 120 similar to first and second sides 18 and 20 of the container 10, first and second ends 122 and 124 similar to the first and second ends 22 and 24 of the container 10, and first and second handles 126 and 128 similar to the first and second handles 26 and 28 of the container 10. The stacking configuration can be achieved by rotating the container 10 (also referred to herein as "the first stackable container") approximately ninety degrees relative to the second container 100 (also referred to herein as "the second stackable container"), so that, for example, the second end 24 of the container 10 is under the first side 118 of the container 100, and aligning the first and second handles 26 and 28 of the first container 10 with corresponding channels or recesses 134 and 136, respectively, on the bottom 112 of the second container 100. While FIGS. 8 and 9 show the first container 10 on the bottom and the second container 100 on top, the reverse configuration is also possible, since each of the containers 10 and 100 has identical features that allow interchangeable stacking of the containers. Thus, while this description primarily addresses the features of the container 10, it should be appreciated that the second container 100, or any other identical container, will have the same features.

Figure 7:
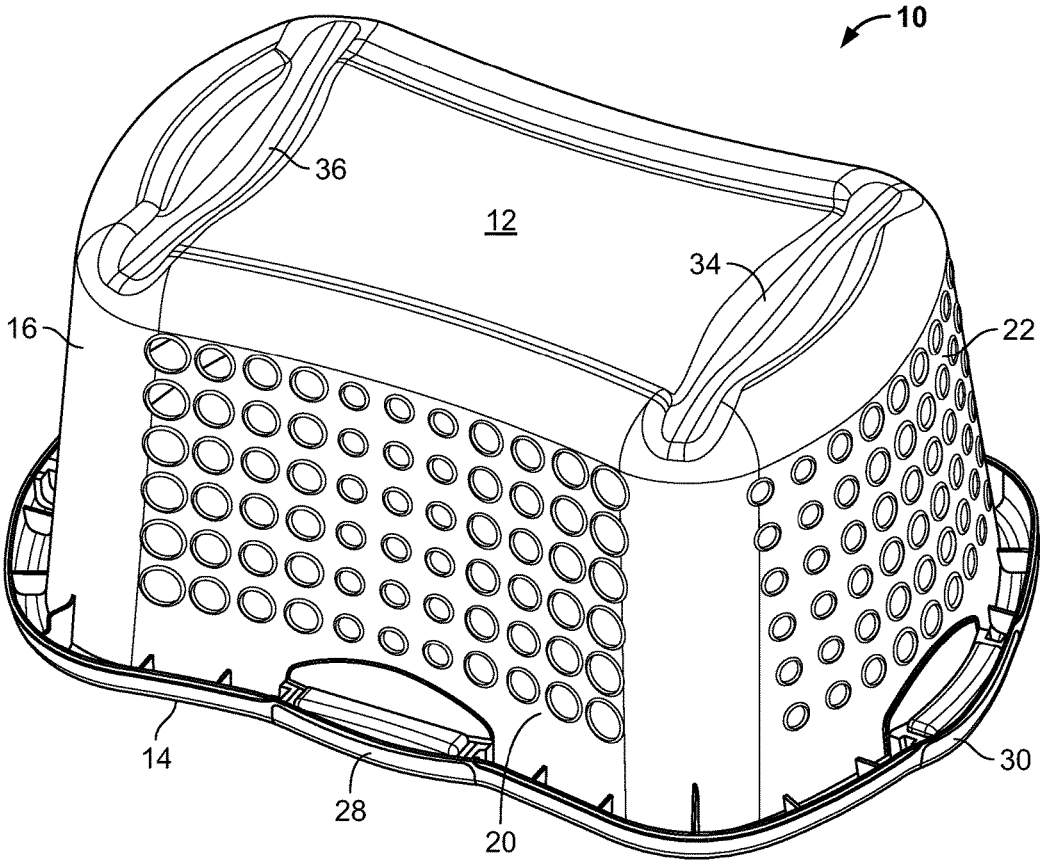
FIG. 7 is a bottom perspective view of the laundry basket shown in FIG. 1, in accordance with various embodiments.

Referring specifically to FIGS. 4, 7, and 9, to facilitate stacking, the container 10 includes first and second channels 34 and 36 that are molded into, or formed within, the bottom 12 and at least partially protrude into the inner space 17. The channels 34 and 36 form recesses capable of receiving the first and second handles, respectively, of any other identical container, including the first and second handles 26 and 28 of the container 10 and the first and second handles 126 and 128 of the container 100. In embodiments, the first channel 34 can be at least partially sized and shaped to receive the first handle 26, or a similar handle of another identical container (e.g., the first handle 126 of container 100), and the second channel 36 can be at least partially sized and shaped to receive the second handle 28, or a similar handle of another identical container (e.g., the second handle 128 of container 100). For example, central portions of the first and second channels 34 and 36 can be curved upwards to match the generally arched shape of the first and second handles 26 and 28. Further, a width of the first and second channels 34 and 36 can be selected to at least match, if not exceed, a width of the first and second handles 26 and 28, respectively, and a length of the first and second channels 34 and 36 can be selected to at least match a length of the first and second handles 26 and 28, respectively.

In some embodiments, the first channel 34 is configured to receive either the first handle 26 or the second handle 28, and likewise, the second channel 36 is configured to receive either the second handle 28 or the first handle 26. For example, the first and second handles 26 and 28 can be identical in shape and size, and likewise, the first and second channels 34 and 36 can be identical in shape and size. This configuration ensures that only a ninety degree turn of the container 10 is required to stack the container 10 with the second container 100, since, for example, either of the sides 18 and 20 of the first container 10 can be aligned with either of the ends 120 and 122 of the second container 100 during stacking.

As shown in FIG. 9, while in the stacking configuration, the inner space 17 of the container 10 is accessible from either of the ends 22 and 24. This configuration is at least partially possible because the length $l_1$ of the sides 18 and 20 is sufficiently larger than the length 12 of the ends 22 and 24. Further, the rounded or curved ends 22 and 24 of the container 10 can help increase the distance $d_2$ between the third and fourth handles 32 and 34, and thus increase a depth of the opening that remains on either side of the container 10 once the two containers 10 and 100 are in the stacked configuration. In some embodiments, the length $l_2$ is specifically selected to leave a sufficient opening for accessing the inner space 17 on either side of the container 10 when stacked under the second container 100 (e.g., in the first stacked configuration). For example, in one embodiment, the length $l_2$ may be twice the length $l_1$.

As shown in FIG. 2, the channels 34 and 36 can be substantially parallel to each other and to the first and second ends 22 and 24, such that the channels 34 and 36 run transversely across the bottom 12 of the container 10. In embodiments, a distance between the first and second channels 34 and 36 is substantially equal to the first distance $d_1$ between the first and second handles 26 and 28, as shown in FIG. 4, in order to facilitate alignment of the handles 26 and 28 with the channels 34 and 36, respectively.

Figure 3:
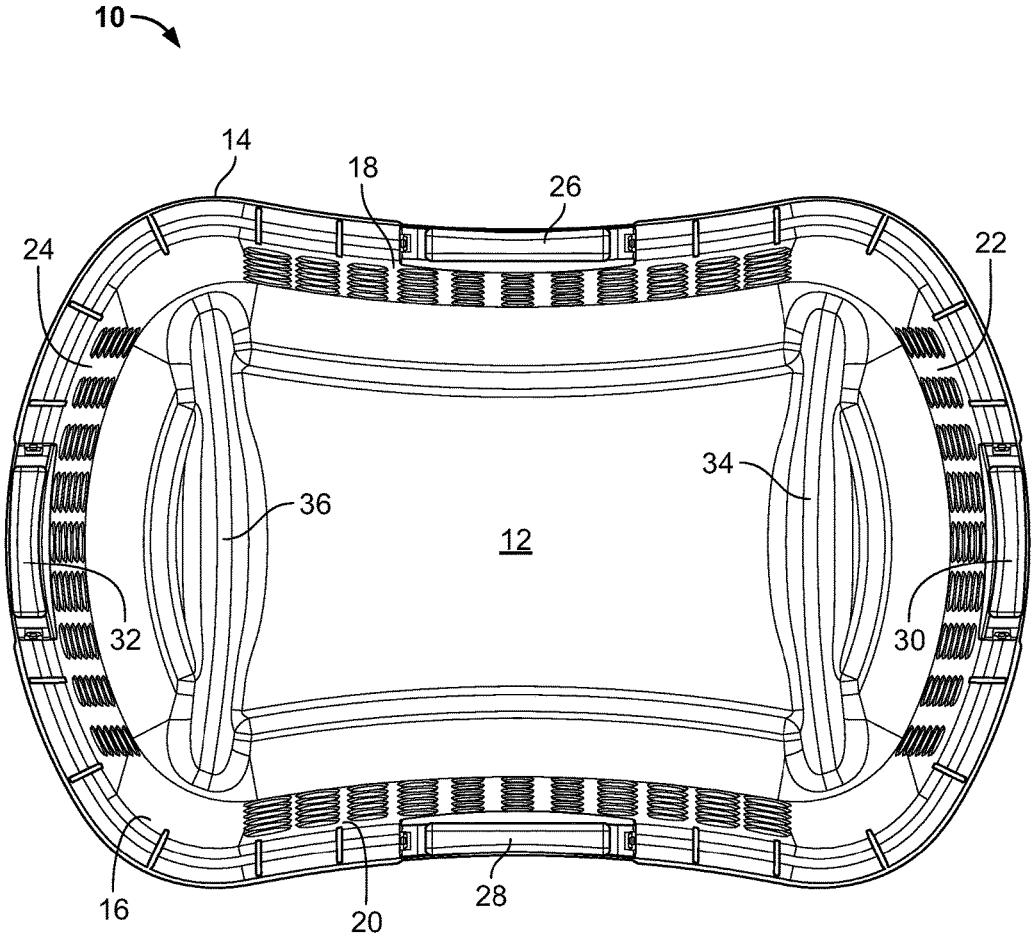
FIG. 3 is a bottom plan view of the laundry basket shown in FIG. 1, in accordance with various embodiments.

In some embodiments, to provide a more secure engagement during stacking, the first channel 34 can be further sized and shaped to receive one or more portions of the top rim 14 that are adjacent to, or on either side of, the first handle 26, and the second channel 36 can be further sized and shaped to receive one or more portions of the top rim 14 that are adjacent to, or on either side of, the second handle 28. For example, a length of each channel 34 and 36 can be selected to span across the entire width of the bottom 12, to increase the amount of surface area on the bottom 12 of the container 10 that is available for engagement with the top rim and handles of the other container. As shown in FIGS. 2 and 3, the channels 34 and 36 can also be curved to match a curvature or other shape of the first and second handles 26 and 28 and/or the top rim 14. For example, since the first and second sides 18 and 20 are curved inwards towards each other, the first and second channels 34 and 36 are also curved inwards towards each other, as shown in FIG. 2.

In some embodiments, the channels 34 and 36 can be configured to catch, or register with, the handles 26 and 28, respectively, so that the handles 26 and 28 are fixed or locked in place within the channels 34 and 36. This may help prevent one container from slipping off the other container while in the stacked configuration. In some cases, the channels 34 and 36 may include a catch or other mechanical locking structures for creating a more secure attachment between the two containers. In other cases, the channels 34 and 36 may be designed or configured to snap onto, or otherwise securely grip, the handles 26 and 28, respectively.

In alternative embodiments, the container 10 does not include the plurality of handles 26, 28, 30, and 32 separate from the top rim 14. Instead, the top rim 14, itself, can be structured or configured to engage the channels 34 and 36 during stacking. For example, the top rim 14 may include a first curved or rounded portion (also referred to herein as "a first curved structure") adjacent to the first side 18 in place of the first handle 26 and a second curved or rounded portion (also referred to herein as "a second curved structure") adjacent to the second side 20 in place of the second handle 26. The first and second curved structures may be formed from, or integrated into, the top rim 14 and have a shape that mimics, or is similar to, the overall shape of the first and second handles 26 and 28, respectively, except that the opening below the handles 26 and 28 for receiving a user's fingers may be omitted. Further, the first and second curved structures may be spaced apart by the first distance $d_1$ shown in FIGS. 4 and 5, like the first and second handles 26 and 28. Thus, the first and second curved structures of the top rim 14 can be configured to engage the channels 34 and 36, like the handles 26 and 28, respectively. In this manner, the top rim 14, itself, can be configured to facilitate stacking of the container 10 with another container 100, as shown in FIGS. 8 and 9, for example.

Though not shown, in some embodiments, the container 10 may include a lid for covering, or blocking access to, the interior space of the container 10. In such embodiments, the lid may be removed prior to stacking or nesting multiple containers in order to allow access to the interior space and to the handles 26 and 28 and the top rim 14. In one example embodiment, the lid may remain in place during stacking but may be removed during nesting. For example, the lid may include structures that are shaped like the top rim 14 and handles 26 and 28 of the container 10 in order to similarly engage the channels 34 and 36 on the bottom of another container.

Thus, an improved stackable, nestable container is provided with features that allow access to the interior space of the container from either end of the container while in a stacked configuration. In particular, the container includes molded-in stacking channels on the base or bottom of the container which are designed to securely fit over or receive the top rim and side handles of a second identical container. The stacked configuration is achieved simply by rotating the first container 90 degrees relative to the second container and placing the stacking channels of the upper container on top of the handles and rim of the bottom container. As a result, the container can be stacked without requiring any extra parts or hardware. When the containers are not in use, they can be fully nested by aligning the containers exactly on top of each other, end to end and side to side.

It should be emphasized that the above-described embodiments, particularly, any "preferred" embodiments, are possible examples of implementations, merely set forth for a clear understanding of the principles of the invention. Many variations and modifications may be made to the above-described embodiment(s) without substantially departing from the spirit and principles of the techniques described herein. All such modifications are intended to be included herein within the scope of this disclosure and protected by the following claims.

What is claimed is:

1. A container capable of being placed in a stacking configuration with an identical second container, the container comprising:

a bottom;

a top rim defining an open top;

a sidewall contiguous with and extending between the bottom and the top rim to define an inner space, the sidewall including:

a first side, a second side opposite and generally parallel to the first side, a first end, and a second end opposite and generally parallel to the first end, wherein the first and second ends are generally perpendicular to the first and second sides;

a first curved structure forming at least part of the top rim adjacent the first side;

a second curved structure forming at least part of the top rim adjacent the second side, the second curved structure being disposed opposite the first curved structure, wherein the first curved structure is spaced apart from the second curved structure by a first distance; and first and second channels molded into the bottom and at least partially protruding into the inner space, the channels being substantially parallel to each other and to the first and second ends, wherein a distance between the first and second channels is substantially equal to the first distance between the first and second curved structures, wherein the first channel is at least partially shaped to receive the first curved structure and the second channel is at least partially shaped to receive the second curved structure.

2. The container of claim 1, wherein each of the first and second curved structures has a generally arched shape that extends above a remainder of the top rim and away from the bottom, and at least a portion of the first channel and at least a portion of the second channel are curved to match the generally arched shape.

3. The container of claim 2, wherein the first channel is further shaped to receive at least a portion of the top rim adjacent the first curved structure, and the second channel is further shaped to receive at least a portion of the top rim adjacent the second curved structure.

4. The container of claim 1, further comprising a plurality of handles, wherein the first curved structure forms a first one of the handles and the second curved structure forms a second one of the handles.

5. The container of claim 4, wherein the plurality of handles further includes a third handle disposed on the first end and a fourth handle disposed on the second end opposite the third handle.

6. The container of claim 1, wherein a length of the first side is greater than a length of the first end.

7. The container of claim 1, wherein a central portion of the first side and a central portion of the second side are curved inwards towards the inner space.

8. The container of claim 1, wherein the sidewall slopes outwards from the bottom to the top rim, such that a circumference of the top rim is greater than a circumference of the bottom.

9. The container of claim 1, wherein the inner space is user-accessible through the first end or the second end upon stacking the second container on top of the container.

10. The container of claim 9, wherein the container is turned ninety degrees relative to the second container when placed in the stacking configuration.

11. First and second stackable containers, each container comprising:

a bottom;

a top rim defining an open top;

a sidewall contiguous with and extending between the bottom and the top rim to define an inner space, the sidewall including:

a first side, a second side opposite and generally parallel to the first side, a first end, and a second end opposite and generally parallel to the first end, wherein the first and second ends are generally perpendicular to the first and second sides;

a first curved structure forming at least part of the top rim adjacent the first side;

a second curved structure forming at least part of the top rim adjacent the second side, the second curved structure being disposed opposite the first curved structure, wherein the first curved structure is spaced apart from the second curved structure by a first distance; and first and second channels molded into the bottom and at least partially protruding into the inner space, the channels being substantially parallel to each other and to the first and second ends, wherein a distance between the first and second channels is equal to the first distance between the first and second curved structures, wherein for each container, the first channel is at least partially shaped to receive the first curved structure and the second channel is at least partially shaped to receive the second curved structure.

12. The first and second stackable containers of claim 11, wherein the first channel is further shaped to receive at least a portion of the top rim adjacent to the first curved structure, and the second channel is further shaped to receive at least a portion of the top rim adjacent to the second curved structure.

13. The first and second stackable containers of claim 11, wherein the containers are placed in a first stacking configuration by placing the first and second channels of the second container on top of the first and second curved structures of the first container, respectively.

14. The first and second stackable containers of claim 13, wherein the containers are placed in a second stacking configuration by aligning the first and second channels of the first container on top of the first and second curved structures of the second container, respectively.

15. The first and second stackable containers of claim 14, wherein in either stacking configuration, the first container is turned ninety degrees relative to the second container.

16. The first and second stackable containers of claim 14, wherein in either stacking configuration, the inner space of the container on the bottom is user-accessible through the first and second ends of said container.

17. The first and second stackable containers of claim 16, wherein for each container, a length of the first side is greater than a length of the first end to enable user access to the inner space of the container placed on the bottom in either stacking configuration.

18. The first and second stackable containers of claim 11, wherein the first and second containers are configured for placement in a nesting configuration.

19. The first and second stackable containers of claim 18, wherein for each container, a circumference of the top rim is greater than a circumference of the bottom to enable the nesting configuration.

20. The first and second stackable containers of claim 11, each container further comprising a plurality of handles, wherein for each container, the first curved structure forms a first one of the handles and the second curved structure forms a second one of the handles.

* * * * *